US009174460B2

(12) United States Patent
Sasaki et al.

(10) Patent No.: US 9,174,460 B2
(45) Date of Patent: Nov. 3, 2015

(54) LIQUID DISCHARGING APPARATUS

(71) Applicant: SEIKO EPSON CORPORATION, Tokyo (JP)

(72) Inventors: Tsuneyuki Sasaki, Matsumoto (JP); Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/150,415

(22) Filed: Jan. 8, 2014

(65) Prior Publication Data

US 2014/0198147 A1 Jul. 17, 2014

(30) Foreign Application Priority Data

Jan. 15, 2013 (JP) ..... 2013-004304

(51) Int. Cl.
*B41J 29/393* (2006.01)
*B41J 11/00* (2006.01)

(52) U.S. Cl.
CPC ..... *B41J 11/0015* (2013.01); *B41J 11/002* (2013.01); *B41J 11/0095* (2013.01)

(58) Field of Classification Search
USPC ..... 347/5, 9, 17, 19, 14, 16
See application file for complete search history.

(56) References Cited

U.S. PATENT DOCUMENTS

| | | | | |
|---|---|---|---|---|
| 7,399,048 | B2 * | 7/2008 | Inoue | 347/19 |
| 2009/0237478 | A1 | 9/2009 | Hara | |
| 2012/0162335 | A1 | 6/2012 | Sasaki | |

FOREIGN PATENT DOCUMENTS

| | | | |
|---|---|---|---|
| JP | 2003-207965 | | 7/2003 |
| JP | 2009-251408 | | 10/2009 |
| JP | 2012-121192 | | 6/2012 |
| JP | 2012-135889 | | 7/2012 |
| JP | 2013-147329 | * | 8/2013 |

OTHER PUBLICATIONS

European Search Report for European patent application No. 14151091.7 dated May 12, 2014.

* cited by examiner

*Primary Examiner* — Lam Nguyen
(74) *Attorney, Agent, or Firm* — Workman Nydegger

(57) ABSTRACT

A liquid discharging apparatus includes a head that discharges a liquid onto a medium, a medium supporting portion that supports the medium, a heater that heats the medium supported by the medium supporting portion, and a detecting unit that performs sensing and detects energy. The radiation energy of the heater is controlled on the basis of the energy detected by the detecting unit. The medium supporting portion is provided with a sensing target portion that can be sensed by the detecting unit.

17 Claims, 5 Drawing Sheets

| | MATERIAL | EMISSIVITY RATIO |
|---|---|---|
| MEDIUM A | ACRYLIC RESIN | 0.8 |
| MEDIUM B | ACRYLIC RESIN | 0.83 |
| MEDIUM C | PET RESIN | 0.85 |
| MEDIUM D | PET RESIN | 0.87 |
| MEDIUM E | VINYL CHLORIDE RESIN | 0.9 |
| MEDIUM F | VINYL CHLORIDE RESIN | 0.9 |
| MEDIUM G | VINYL CHLORIDE RESIN | 0.91 |
| MEDIUM H | FABRIC | 0.92 |
| MEDIUM I | PAPER | 0.94 |
| MEDIUM J | FABRIC | 0.95 |
| MEDIUM K | PAPER | 0.95 |

| | MATERIAL | EMISSIVITY RATIO |
|---|---|---|
| MEDIUM A | ACRYLIC RESIN | 0.8 |
| MEDIUM B | ACRYLIC RESIN | 0.83 |
| MEDIUM C | PET RESIN | 0.85 |
| MEDIUM D | PET RESIN | 0.87 |
| MEDIUM E | VINYL CHLORIDE RESIN | 0.9 |
| MEDIUM F | VINYL CHLORIDE RESIN | 0.9 |
| MEDIUM G | VINYL CHLORIDE RESIN | 0.91 |
| MEDIUM H | FABRIC | 0.92 |
| MEDIUM I | PAPER | 0.94 |
| MEDIUM J | FABRIC | 0.95 |
| MEDIUM K | PAPER | 0.95 |

LIQUID DISCHARGING APPARATUS

This application claims the benefit of Japanese Patent Application No. 2013-004304, filed on Jan. 15, 2013, which is incorporated herein by reference.

BACKGROUND

1. Technical Field

Embodiments of the present invention relate to a liquid discharging apparatus.

2. Related Art

A liquid discharging apparatus that includes a head that discharges a liquid onto a medium, a medium supporting portion that supports the medium, and a heater that cures the liquid by heating the medium supported by the medium supporting portion is known.

In addition, the liquid discharging apparatus may be provided with an infrared sensor that detects the energy of infrared rays by sensing the surface of the medium within a heating range of the heater. Furthermore, in this case, the controller controls the radiation energy of the heater based on the energy detected by the infrared sensor.

JP-A-2009-251408 is an example of the related art.

Due to the configuration of the infrared sensor described above, the infrared sensor senses a sensing target portion that is provided on the medium supporting portion when the medium is not present at the sensing destination. Because the situation at the sensing destination when the medium is not present is different from the situation where the surface of the medium is sensed, there is a problem in that radiation energy control may not be performed in the same manner as when the medium is at the sensing destination.

SUMMARY

An advantage of some aspects of embodiments of the invention is that a heater of an apparatus such as a liquid discharging apparatus is controlled appropriately. The heater is controlled appropriately both when a medium is present and when a medium is not present at a sensing area.

According to an aspect of an embodiment of the invention, a liquid discharging apparatus is provided. The liquid discharging apparatus includes a head that discharges a liquid onto a medium, a medium supporting portion that supports the medium, and a heater that heats the medium supported by the medium supporting portion. The liquid discharging apparatus also includes a detecting unit that performs sensing and detects energy (e.g., detects the radiation or infrared ray energy present at a sensing area). The discharging apparatus also controls radiation energy of the heater based on the energy detected by the detecting unit. The medium supporting portion of the apparatus is provided with a sensing target portion which is sensed by the detecting unit, and in which an emissivity of the sensing target portion is set to be between 0.7 and 1, inclusive, in one example.

Other features and advantages of embodiments of the invention will be made clear by the description of the specification and the accompanying drawings.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
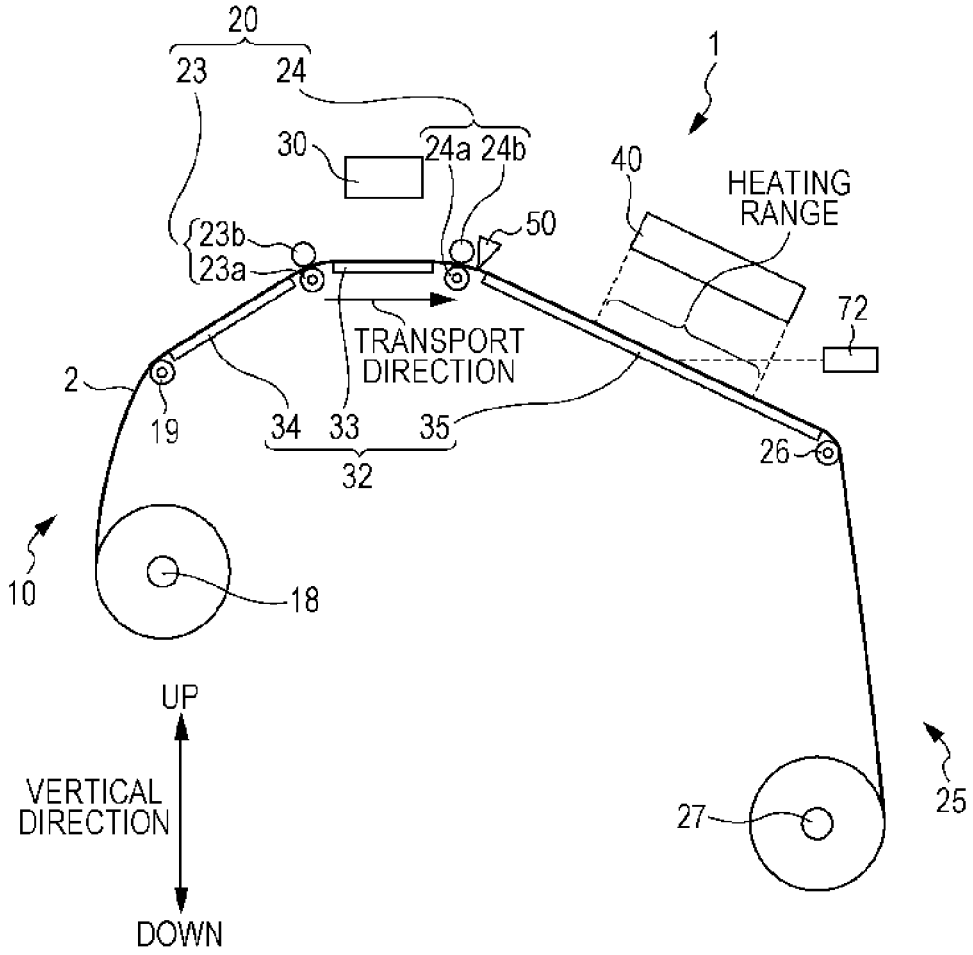
FIG. 1 is a schematic diagram showing an example of a configuration of a liquid discharging apparatus such as a printer.

Embodiments of the invention relate to a liquid discharging apparatus that includes a head that discharges a liquid onto a medium, a medium supporting portion that supports the medium, a heater that heats the medium supported by the medium supporting portion, and a detecting unit that performs sensing and detects energy and that controls radiation energy of the heater on the basis of the energy detected by the detecting unit. The medium supporting portion is provided with a sensing target portion. When a medium is not present, the sensing target portion is sensed (e.g., by sensing energy radiated by the sensing target portion) by the detecting unit. An emissivity of the sensing target portion is from 0.7 to 1 or between 0.7 and 1, inclusive.

Embodiments of the invention control the heater appropriately and more specifically control the energy radiated by the heater during operation of the liquid discharging apparatus both when a medium is in a heating range of the heater and when a medium is not present in the heating range of the heater. Thus, the detecting unit may sense the sensing target portion (which may be part of the medium supporting portion) or the medium supported by the medium supporting portion.

When the sensing target portion is sensed, it is possible to produce a situation in which radiation energy control is executed in the same manner as when the medium supported by the medium supporting portion is sensed, and it is possible to realize appropriate heater control in both situations.

In addition, embodiments of the invention are configured such that a difference between the emissivity of the sensing target portion and the emissivity of the medium may be 0.1 or less. In this case, it is possible to perform control of the heater appropriately.

In addition, the sensing target portion may be formed from anodized aluminum or from another suitable material. In this case, it is possible to control the heater appropriately using a simple method while benefitting from the merit of using a high-strength material such as metal as the medium supporting portion.

In addition, a heat capacity of the medium that is located in a heating range of the heater and the heat capacity of the sensing target portion are substantially equal. In this case, it is possible to perform control of the heater appropriately.

In addition, the medium supporting portion may be provided with a non-sensing target portion which is not sensed by the detecting unit, and a gap may be provided between the sensing target portion and the non-sensing target portion. In this case, it is possible to realize the heater control appropriately using a simple method.

In addition, the medium supporting portion may be a thin plate, and the medium supporting portion may further include a supporting portion that supports the thin plate in a state where a gap is provided between the thin plate and the supporting portion.

In this case, it is possible to realize the heater control appropriately using a simple method while realizing a configuration in which the medium supporting portion is firmly supported.

In addition, a size of a sensing area that the detecting unit senses may be variable, and the size of change in the sensing area between when the detecting unit senses the sensing target portion and when the detecting unit senses the medium supported by the medium supporting portion may be variable. For example, the size of the sensing area when sensing the sensing target portion may be smaller than the size of the sensing area when sensing the medium.

In this case, since it is possible to appropriately exhibit the capability of the detecting unit, it is possible to realize the heater control more appropriately.

Schematic Example of an Example Configuration of a Liquid Discharging Apparatus

Figure 2:
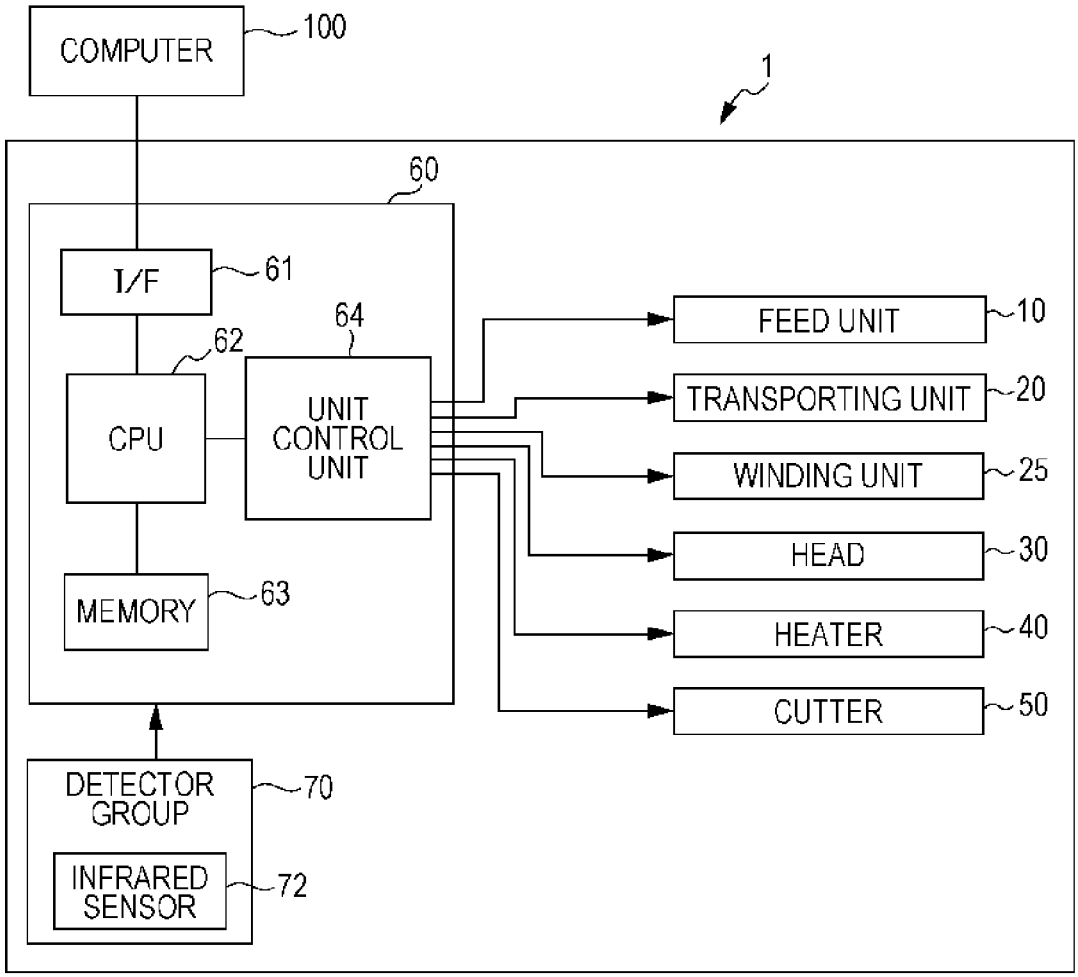
FIG. 2 is a block diagram of an example configuration of the liquid discharging device.

FIG. 1 is a schematic diagram showing an example of a configuration of a liquid discharging apparatus (hereinafter simply referred to as the printer 1). An ink jet printer as an example of the liquid discharging apparatus. FIG. 2 is a block diagram of an example configuration of the printer 1.

As shown in FIGS. 1 and 2, the printer 1, in one embodiment, may include a feed unit 10, a transporting unit 20, a winding unit 25, a head 30, a roll-shaped medium supporting body 32, a heater 40, a cutter 50, a controller 60 and a detector group 70.

The feed unit 10 feeds a roll-shaped medium 2, which is an example of a medium, to the transporting unit 20. As shown in FIG. 1, the feed unit 10 may include a roll-shaped medium winding shaft 18, around which the roll-shaped medium 2 is wound to be rotatably supported, and a relay roller 19 for winding the roll-shaped medium 2 which is fed out from the roll-shaped medium winding shaft 18 and for guiding the roll-shaped medium 2 to the transporting unit 20.

The feed unit 10 is configured to feed the medium to the transporting unit 20. The winding shaft 18 and the relay roller 19 guide the roll-shaped medium 2 to the transporting unit 20.

The transporting unit 20 transports the roll-shaped medium 2, which is sent by the feed unit 10, in a transport direction along a transport path that may be set in advance. As shown in FIG. 1, the transporting unit 20 includes a first transport roller 23 and a second transport roller 24. The second transport roller 24 is positioned on the downstream side in the transport direction in relation to the first transport roller 23. The first transport roller 23 includes a first drive roller 23*a* that is driven by a motor and a first driven roller 23*b* which is disposed so as to face the first drive roller 23*a*. The roll-shaped medium 2 may be interposed between the driven roller 32*b* and the drive roller 23*a* during transport. Similarly, the second transport roller 24 includes a second drive roller 24*a* that is driven by a motor, and a second driven roller 24*b* which is disposed so as to face the second drive roller 24*a*. The the roll-shaped medium 2 is interposed between the driven roller 24*b* and the drive roller 24*a* during transport.

The winding unit 25 is configured to wind the roll-shaped medium 2 (the image recorded roll-shaped medium 2) which is sent or transported by the transporting unit 20. The winding unit 25 winds the roll-shaped medium 2 after an image is printed thereon. As shown in FIG. 1, the winding unit 25 includes a relay roller 26 for winding the roll-shaped medium 2, which is sent from the second transport roller 24 from the upstream side in the transport direction and for transporting the roll-shaped medium 2 to the downstream side in the transport direction. The winding unit 25 may also include a roll-shaped medium winding drive shaft 27 which is rotatably supported and which winds the roll-shaped medium 2 which is sent from the relay roller 26.

The head 30 is configured for recording (printing) an image onto a part of the roll-shaped medium 2 which is positioned in an image recording region of the transport path. In other words, as shown in FIG. 1, the head 30 forms an image by discharging an ink, which is an example of a liquid, from an ink discharge nozzle onto the roll-shaped medium 2 which is sent over a platen 33 (described below) by the transporting unit 20.

Furthermore, a piezo element is provided in the ink discharge nozzle as the drive element for discharging ink droplets. When an appropriately configured voltage of a predetermined duration is applied across electrodes provided at both ends of the piezo element, the piezo element stretches or flexes according to the application time of the voltage and causes the side walls of the ink flow path to deform. Accordingly, the volume of the ink flow path expands and contracts according to the expansion and contraction of the piezo element, and the ink which is equivalent to the amount of contraction becomes an ink droplet and is discharged from the ink discharge nozzle.

The roll-shaped medium supporting body 32 is configured for supporting the roll-shaped medium 2 from below. The roll-shaped medium supporting body 32 may be made from metal (e.g., aluminum). In one embodiment, the roll-shaped medium supporting body 32 may include, as shown in FIG. 1, the platen 33 which opposes the head 30, an upstream side supporting member 34 which is positioned on the upstream side in the transport direction of the platen 33, and a downstream side supporting member 35 (equivalent to the medium supporting portion) which is positioned on the downstream side in the transport direction of the platen 33.

The heater 40 is configured for curing or drying the ink by heating the roll-shaped medium 2 (in other words, heating the ink or liquid on the roll-shaped medium 2). The heater 40 may be an infrared heater that radiates infrared rays or infrared energy. As shown in FIG. 1, the heater 40 may be provided in a position that opposes the downstream side supporting member 35. In other words, the heater 40 heats the roll-shaped medium 2 when the medium 2 is supported by the downstream side supporting member 35. The heater 40 heats the roll-shaped medium 2 and/or ink printed on the medium 2 after the portion of roll-shaped medium 2 on which ink is printed has been transported to the heater 40.

The cutter 50 is configured for cutting the roll-shaped medium 2. The liquid discharging apparatus may operate in a non-winding mode and in a winding mode.

When the non-winding mode (described below) is executed or performed, the cutter 50 may cut the image recorded roll-shaped medium 2 off from the non-image recorded roll-shaped medium 2 by cutting the roll-shaped medium 2. As shown in FIG. 1, the cutter 50 is provided between the head 30 and the heater 40 in the transport direction.

In addition, as shown in FIG. 2, the printer 1 is provided with the controller 60 which manages or controls the operation of the printer 1. The controller 60 controls the units and the like described above, and the detector group 70. After receiving a print command (print data) from a computer 100, which is an example of an external apparatus that can generate print data, the printer 1 controls each of the units (the feed unit 10, the transporting unit 20, the winding unit 25, the head 30, the heater 40 and the cutter 50) using the controller 60. The controller 60 prints an image onto the roll-shaped medium 2 by controlling each unit on the basis of the print data received from the computer 100. The situation within or status of the printer 1 is monitored by the detector group 70, and the detector group 70 outputs a detection result to the controller 60. The controller 60 may control each unit on the basis of the detection results output from the detector group 70.

Furthermore, as shown in FIGS. 1 and 2, an infrared sensor 72, which is an example of a detecting unit, is provided as one of the detectors in the detector group 70. The infrared sensor 72 detects energy of infrared rays by sensing the surface of the roll-shaped medium 2 within the heating range (in other words, within the radiation range (see FIG. 1)) of the heater 40. Furthermore, the radiation energy of the heater 40 is controlled by the controller 60 on the basis of the energy detected by the infrared sensor 72.

The controller 60 may be a control unit for performing control of the printer 1. The controller 60 includes an interface unit 61, a CPU 62, memory 63 and a unit control unit 64. The interface unit 61 enables data to be exchanged with the computer 100 and the printer 1. The CPU 62 is a processing unit for performing overall control of the printer 1. The memory 63 includes a region for storing programs of the CPU 62 and may include a working region. The memory 63 may include a memory element such as RAM, which is volatile memory, or EEPROM, which is non-volatile memory. The CPU 62 controls each unit via the unit control unit 64 in accordance with the program stored in the memory 63.

Regarding Execution Modes of the Liquid Discharging Apparatus

Figure 3A:
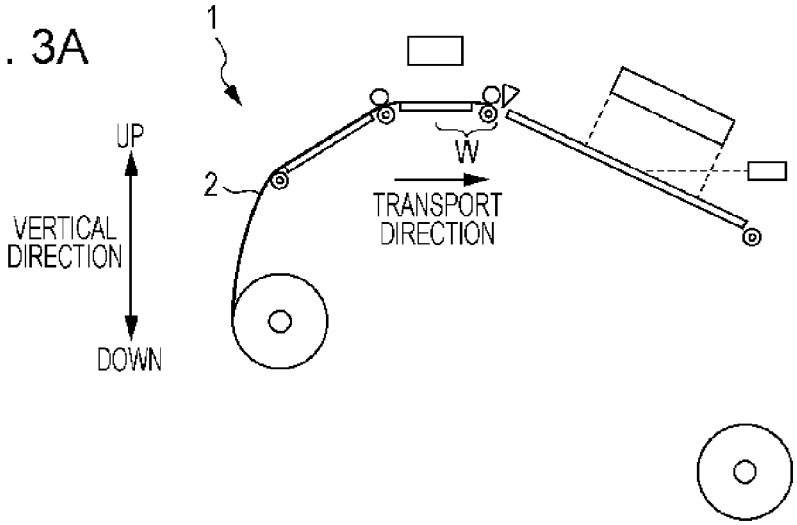
FIGS. 3A to 3C illustrate an example of a non-winding mode in the liquid discharging apparatus.
Figure 3B:
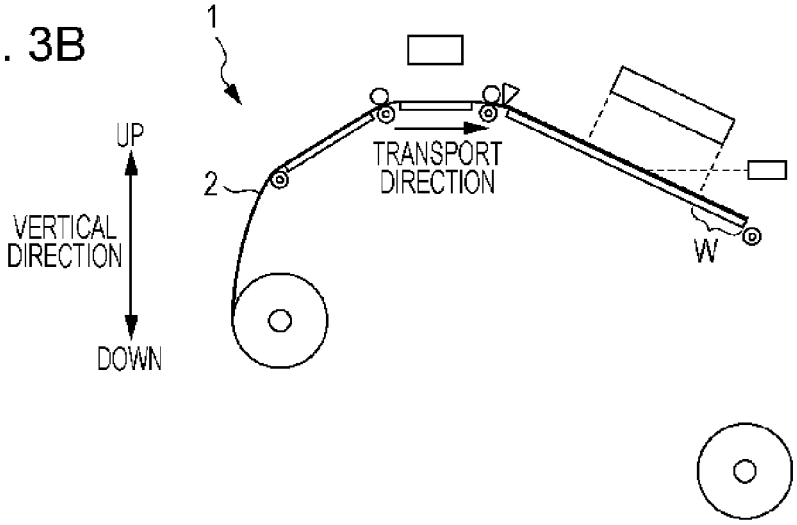
Figure 3C:
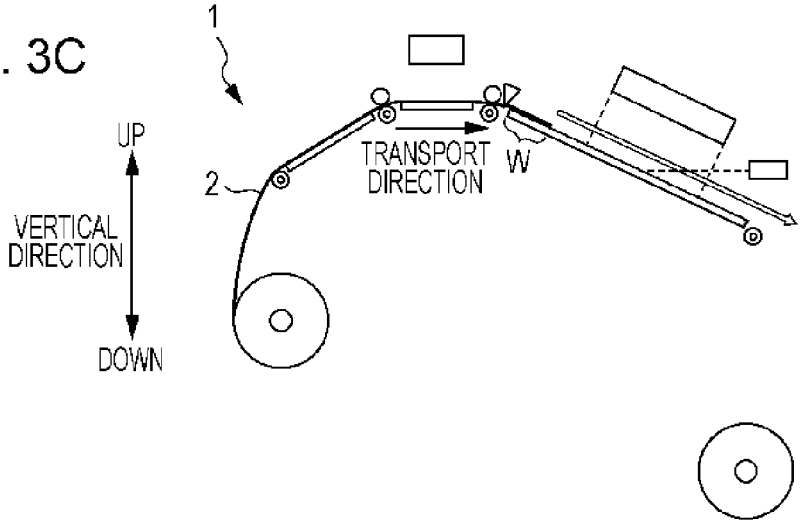

Next, a description of the winding mode and the non-winding mode, which the execution modes of the printer 1, are provided. The description of the winding mode and the non-winding mode references FIGS. 1 and 3A to 3C. FIGS. 3A to 3C are views that illustrate a non-winding mode. Furthermore, since the state of the printer 1 in which the winding mode is executed is represented in FIG. 1, the winding mode will be described with reference to FIG. 1.

The execution modes of the printer 1 include a non-winding mode. The winding unit 25 is not used and the image recorded roll-shaped medium 2 is not wound by the roll-shaped medium winding drive shaft 27 in the non-winding mode.

The winding unit 25 is used and the image recorded roll-shaped medium 2 is wound by the roll-shaped medium winding drive shaft 27 when the printer 1 is executing the winding mode.

In other words, the controller 60 is configured to execute a winding mode in which the winding unit 25 is caused to wind the roll-shaped medium 2 that is transported by the transporting unit 20. The controller 60 is also configured to execute a non-winding mode in which the winding unit 25 is not caused to wind the roll-shaped medium 2 that is transported by the transporting unit 20.

As shown in FIG. 1, when the winding mode is executed, the roll-shaped medium 2 is transported by the transporting unit 20 while maintaining a state of being wound around both the feed unit 10 and the winding unit 25 (the roll-shaped medium winding shaft 18 and the roll-shaped medium winding drive shaft 27).

Furthermore, a part of the roll-shaped medium 2 that is fed out from the roll-shaped medium winding shaft 18 reaches a position that opposes the head 30 and an image is formed on that part at that position. When the roll-shaped medium 2 is further transported, the part on which the image is formed eventually reaches a position that opposes the heater 40, and that image recorded part is irradiated with infrared rays at the position opposite the heater 40. Furthermore, when the roll-shaped medium 2 is transported further, the part reaches the winding unit 25 and is wound onto the roll-shaped medium winding drive shaft 27.

During the winding mode, the medium unwinds from the winding shaft 18 and passes along a transport path in the printer 1 until the medium is wound around the drive shaft 27. During transport, an image may be recorded on the medium.

FIGS. 3A to 3C illustrate the execution of the non-winding mode. In the non-winding mode, the roll-shaped medium 2 is transported by the transporting unit 20 while maintaining a state of being wound around only the feed unit 10. The roll-shaped medium 2 is not wound around the drive shaft 27 in the non-winding mode.

Furthermore, a part of the roll-shaped medium 2 that is fed out from the roll-shaped medium winding shaft 18 reaches the position which opposes the head 30 and an image (an example of the image formed range in the roll-shaped medium 2 is shown in FIGS. 3A to 3C with the symbol W) is formed (FIG. 3A shows a state in which the image formation is complete) on the part at the position. The W shown in FIGS. 3A to 3C can be used to follow the transport of the medium in the non-winding mode.

The image formed range W reaches the position which opposes the heater 40 because the roll-shaped medium 2 is transported after the image has been formed. The image formed range W is irradiated with infrared rays at the position opposite the heater 40. The image formed range W may be continuously transported through the heating range or may be transported in stages. The image formed range W, for example, may be in the heating range while an image is formed on another portion of the medium opposite the head 30. The time spent by the image formed range W in the heating range may be controlled by the controller 60. FIG. 3B illustrates a state in which the radiation of infrared rays onto the image formed range W has been completed and the image formed range W is not opposite the heater 40.

Next, the roll-shaped medium 2 is transported in a backward direction (back fed) by the transporting unit 20. Then, the image formed range W is returned such that the image formed range W is in front of the cutter 50. In this position, the roll-shaped medium 2 is cut by the cutter 50 (refer to FIG. 3C). As a result, the image recorded roll-shaped medium 2 is cut off from the non-image recorded roll-shaped medium 2, and the cut-off image recorded roll-shaped medium 2 moves (is discharged) in the direction of the long white arrow while sliding on the downstream side supporting member 35.

Regarding Problem in Non-Winding Mode and Contrivances which Downstream Side Supporting Member 35 is Subjected As described above, the printer 1 is provided with the cutter 50, and the printer 1 is capable not only of executing the normal winding mode, but also the non-winding mode.

As shown in FIGS. 3A to 3C, when the non-winding mode is executed, there is a case in which the roll-shaped medium 2 is positioned on the downstream side supporting member 35 (for example, the state shown in FIG. 3B), and a case in which the roll-shaped medium 2 is not positioned on the downstream side supporting member 35 (for example, the state shown in FIG. 3A).

The problem described below may occur. However, the downstream side supporting member 35 is subjected to countermeasures (contrivances) for solving (in other words, suppressing) the problem.

Figure 4:
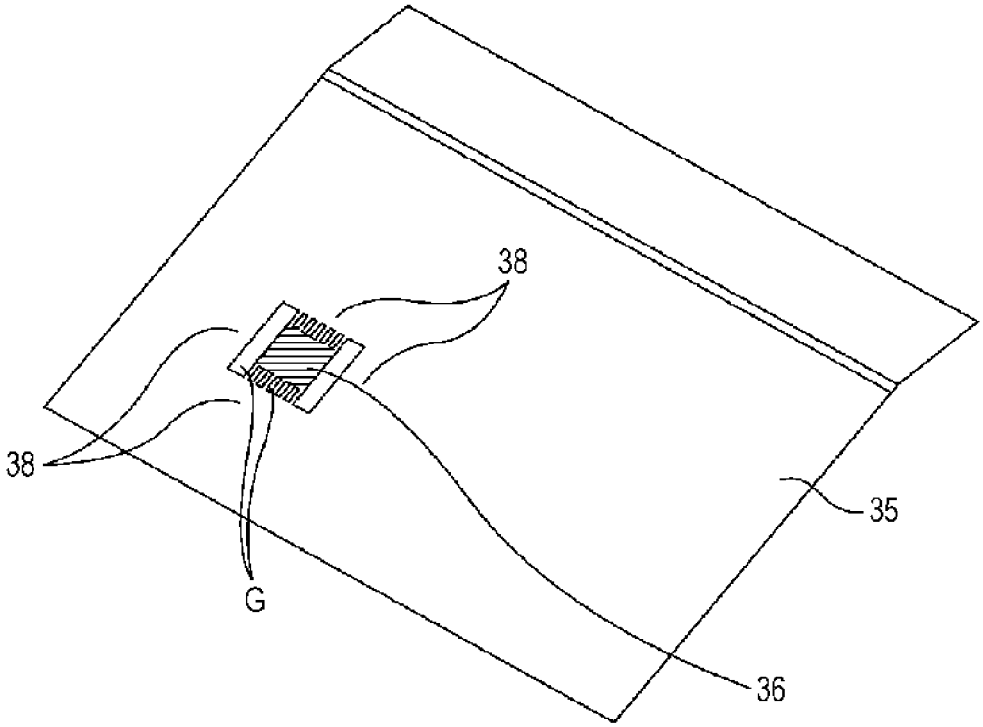
FIG. 4 is a perspective view of a downstream side supporting member in the liquid discharging apparatus.
Figure 5:
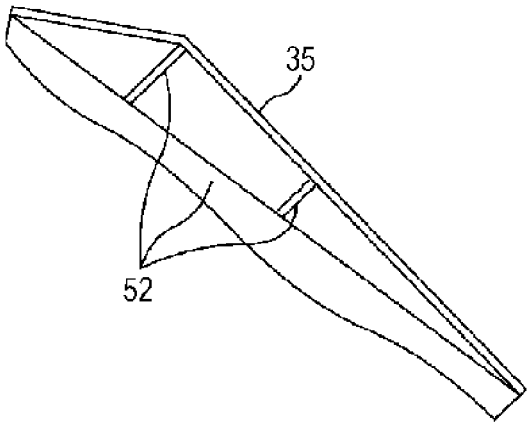
FIG. 5 is a view of the downstream side supporting member shown in FIG. 4 and the peripheral members thereof when observed from the side of the liquid discharging apparatus.

First, a description will be given below of the problem. After the description of the problem, a description will be given of the contrivances to which the downstream side supporting member 35 is subjected with reference to FIGS. 4 and 5. FIG. 4 is a perspective view of a downstream side supporting member 35. FIG. 5 is a view of the downstream side supporting member 35 shown in FIG. 4 and the peripheral members thereof when observed from the side. Furthermore, the state of the downstream side supporting member 35 when observed from the side is also represented in FIG. 1. However, the downstream side supporting member 35 of FIG. 1 is a view of the downstream side supporting member 35 of FIG. 5 re-written schematically.

Regarding Problem

As described above, when the non-winding mode is executed, the roll-shaped medium 2 is sometimes positioned on the downstream side supporting member 35 and sometimes is not positioned on the downstream side supporting member 35.

When the roll-shaped medium 2 is positioned on the downstream side supporting member 35, the infrared sensor 72 senses the surface (or a portion thereof) of the roll-shaped medium 2 within the heating range of the heater 40. Furthermore, the controller 60 controls the radiation energy of the heater 40 on the basis of the energy of the infrared rays detected by the infrared sensor 72. Accordingly, the roll-shaped medium 2 is to be set to a predetermined temperature (approximately 100° C. in one embodiment). In one example, the units are controlled by the controller 60 such that the roll-shaped medium 2 reaches the predetermined temperature.

However, when a state is entered in which the roll-shaped medium 2 is not positioned on the downstream side supporting member 35, the roll-shaped medium 2 is not present at the sensing destination. In this case, the infrared sensor 72 senses the downstream side supporting member 35. The portion of the downstream side supporting member 35 which is sensed is referred to as a sensing target portion 36. In other words, the sensing target portion 36 provided on the downstream side supporting member 35 is sensed by the infrared sensor 72 (the roll-shaped medium 2 is not sensed because it is not present in this case). The radiation energy is controlled based on the sensing results obtained from sensing the sensing target portion 36.

More generally, there is a case in which the detecting unit senses the sensing target portion provided on the medium supporting portion, and there is a case in which the detecting unit senses the medium supported by the downstream medium supporting portion.

The state when the roll-shaped medium is present on or supported by the downstream side supporting member 35 a first state and the state when the roll-shaped member is not present on or supported by the downstream side supporting member 35 is a second state.

In the second state, the situation at the sensing destination is different (for example, the difference between paper and metal) from the first state. When the surface of the roll-shaped medium 2 is sensed (the first state), radiation energy control may not be performed in the same manner as when the roll-shaped medium 2 is not at the sensing destination (the second state). Therefore, when the roll-shaped medium 2 has entered the first state of being positioned on the downstream side supporting member 35 from the second state (in other words, when the roll-shaped medium 2 reaches the downstream side supporting member 35 and is opposite the heater 30), a problem occurs in that the radiation energy is not appropriately set for setting the roll-shaped medium 2 to the predetermined temperature.

Therefore, when the roll-shaped medium is not present at the sensing destination, it is desirable that radiation energy control be performed in the same manner as when the roll-shaped medium 2 is present at the sensing destination. In this configuration, when the roll-shaped medium 2 has entered a state of being positioned on the downstream side supporting member 35 from the second state (in other words, when the roll-shaped medium 2 reaches the downstream side supporting member 35), the radiation energy is already appropriately set for setting the roll-shaped medium 2 to the predetermined temperature. In other words, the radiation energy of the heater 40 is controlled such that the roll-shaped medium 2 can be set to the predetermined temperature when the roll-shaped medium 2 (the image recorded portion, for example) reaches the downstream side supporting member 35.

Regarding Contrivances which Downstream Side Supporting Member 35 is Subjected to In one embodiment, the radiation energy control is executed when the roll-shaped medium 2 is not present at the sensing destination in the same manner as when the roll-shaped medium 2 is present at the sensing destination. In one example, the characteristics of the sensing target portion 36 which is sensed by the infrared sensor 72 in a state in which the roll-shaped medium 2 is not present at the sensing destination are matched or sufficiently matched with the characteristics of the roll-shaped medium 2. This ensures that the radiation energy control is the same both when the roll-shaped medium 2 is present and when the roll-shaped medium 2 is not present.

In one example, the heat capacity of the sensing target portion 36 is matched or sufficiently matched with the heat capacity of the roll-shaped medium 2. More specifically, the volume (the volume of the portion shaded with diagonal lines in FIG. 4) of the sensing target portion 36 is set or sized such that the heat capacity of the roll-shaped medium 2 which is in the heating range (refer to FIG. 1) of the heater and the heat capacity of the sensing target portion 36 (e.g., the portion shaded with diagonal lines in FIG. 4) are substantially equal. Since the heat capacity per unit volume of the sensing target portion 36, which may be made from metal, is higher than that of the roll-shaped medium 2, as described below, a countermeasure is performed so as to reduce the volume of the sensing target portion 36, which is made from metal, as much as possible.

Furthermore, in order to realize the reduction in volume, the configuration of the downstream side supporting member 35 is subjected to the contrivance which is described below.

In other words, as shown in FIG. 4, a gap G is provided between the sensing target portion 36 and a non-sensing target portion 38 (which is not sensed). The gap G is positioned on the periphery of the sensing target portion 36. In other words, in order to narrow the sensing target portion 36 or reduce the volume of the sensing target portion 36, the sensing target portion 36 is treated as a small island-shape, and is isolated from the non-sensing target portion 38. The gap G may be configured such that the volume of the sensing target portion 36 is isolated from the non-sensing target portion 38 of the downstream side supporting member 35.

Furthermore, as shown in FIG. 5, in order to reduce the thickness of the sensing target portion 36, the downstream side supporting member 35, which is provided with the sensing target portion 36 is configured from a thin plate (in one embodiment, a thin plate of a 0.5 mm thickness or on the order of 0.5 mm). A supporting portion 52 is provided which supports the thin plate in a state in which a gap is provided between the thin plate and the supporting portion. In other words, by suspending the downstream side supporting member 35, which is a thin plate, from the supporting portion 52, the thickness of the sensing target portion 36 is reduced while realizing a configuration in which the downstream side supporting member 35 is firmly supported. As a result, the volume of the sensing target portion 36 is controlled by the gap G and by the gap between the thin plate and the supporting portion.

Figures 6, 7:
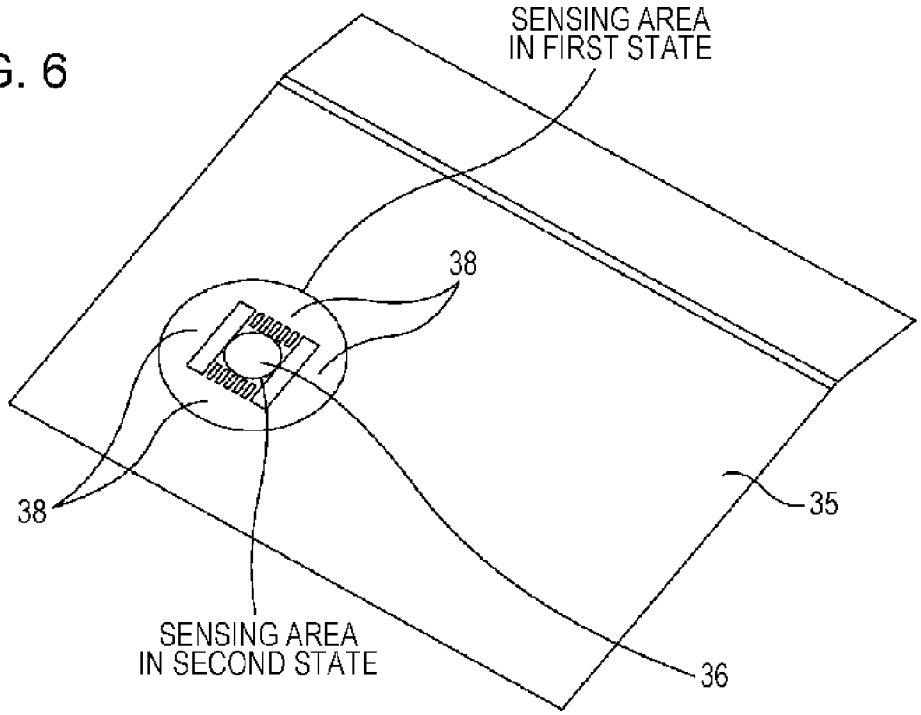
FIG. 6 is a schematic diagram showing an example of a change in a sensing area.
FIG. 7 is a schematic diagram showing an example of an emissivity of a roll-shaped medium.

In addition, the emissivity of the sensing target portion 36 is matched or is sufficiently matched with the emissivity of the roll-shaped medium 2. As shown in FIG. 7, when the emissivity of the main medium used as the roll-shaped medium 2 was measured using an emissivity measuring instrument, the emissivity of the medium was in the range of approximately 0.8 to approximately 0.95. Therefore, the emissivity of the sensing target portion is set to be between 0.7 and 1, inclusive. By using these values, the difference (the emissivity difference) between the emissivity of the sensing target portion 36 and the emissivity of the roll-shaped medium 2 is 0.1 or less. When the emissivity difference is 0.1 or less, the emissivity difference is equivalent to approximately 3° C. or less when converted into a temperature difference. This is considered to be a level that is not a problem for temperature control and is an example of the sensing target portion 36 being sufficiently matched or matched to the medium. Therefore, when the emissivity of the sensing target portion 36 is set to be between 0.7 and 1, it is possible to appropriately perform control of the heater 40 in relation to a medium such as, by way of example only, an acrylic resin, a PET resin, a vinyl chloride resin, fabric or paper. In addition, when the emissivity of the sensing target portion 36 is set between 0.85 and 0.95, inclusive, it is possible to further reduce the emissivity difference in relation to a medium such as a PET resin, a vinyl chloride resin, fabric and paper. Therefore, when the emissivity of the sensing target portion 36 is set between 0.85 and 0.95, it is possible to more appropriately perform control of the heater 40 in relation to some types of media. In addition, when the emissivity of the sensing target portion 36 is set to 0.9, it is possible to further reduce the emissivity difference in relation to, by way of example only, a vinyl chloride resin medium. Therefore, when the emissivity of the sensing target portion 36 is set to 0.9, it is possible to more appropriately perform control of the heater 40 in relation to some types of media.

Because the emissivity of the sensing target portion 36, which may be made from aluminum (the emissivity of aluminum is approximately 0.1), is less than that of the roll-shaped medium 2, as described below, a countermeasure is performed so as to increase the emissivity of the sensing target portion 36.

In one example, the downstream side supporting member, or portion thereof (e.g., the target sensing portion 36), is anodized. By anodizing the downstream side supporting member 35, which may be made from aluminum, the emissivity of the sensing target portion 36 which is provided on the downstream side supporting member 35 rises greatly. The emissivity may rise from approximately 0.1 to approximately 0.9 or to between 0.7 and 1, and the difference (the emissivity difference) between the emissivity of the sensing target portion and the emissivity of the roll-shaped medium 2 is 0.1 or less.

Regarding Validity of Printer 1

As described above, the printer 1 may include the head 30 which discharges an ink onto the roll-shaped medium 2, the downstream side supporting member 35 which supports the roll-shaped medium 2, the heater 40 which heats the roll-shaped medium 2 supported by the downstream side supporting member 35, and the infrared sensor 72 which performs sensing and detects energy. In addition, the printer 1 controls radiation energy of the heater 40 on the basis of or based on the energy detected by the infrared sensor 72. In addition, the downstream side supporting member 35 is provided with the sensing target portion 36 which is sensed by the infrared sensor 72. The infrared sensor 72 can detect the energy radiated by the sensing target portion 36 or, when present, the energy radiated by the roll-shaped medium 2. The heater 40 is then controlled based on the output of the infrared sensor 72.

In other words, the printer 1 includes the head 30 which discharges the ink onto the roll-shaped medium 2, the downstream side supporting member 35 which supports the roll-shaped medium 2, the heater 40 which cures the ink by heating the roll-shaped medium 2 supported by the downstream side supporting member 35, the infrared sensor 72 which detects energy of infrared rays by sensing the surface of the roll-shaped medium 2 within the heating range of the heater 40, and which senses the sensing target portion 36 provided on the downstream side supporting member 35 when the roll-shaped medium 2 is not present at the sensing destination, and the controller 60 which controls radiation energy of the heater 40 on the basis of the energy detected by the infrared sensor 72. Furthermore, in the printer 1, the emissivity of the sensing target portion is set to be between 0.7 to 1.

The controller 60 can then control radiation energy (or control the heater 40) in the same manner both when the roll-shaped medium 2 is present at the sensing destination and when the roll-shaped medium 2 is not present at the sensing destination. The heater 40 can be controlled appropriately.

In addition, the difference between the emissivity of the sensing target portion and the emissivity of the roll-shaped medium 2 is set to be 0.1 or less in one embodiment.

Therefore, the radiation energy is controlled in the same manner both when the roll-shaped medium 2 is present at the sensing destination and when the roll-shaped medium 2 is not present at the sensing destination, and it is possible to perform control of the heater 40 appropriately.

In addition, in the embodiment, the sensing target portion 36 may be formed from anodized aluminum.

Therefore, when the roll-shaped medium 2 is not present at the sensing destination, it is possible to create a situation in which the radiation energy control is executed in the same manner as when the roll-shaped medium 2 is present at the sensing destination using a simple method while benefitting from the merit of using a high-strength material such as metal as the downstream side supporting member 35, and it is possible to realize the heater control appropriately.

In addition, the heat capacity of the roll-shaped medium 2 which is in the heating range (refer to FIG. 1) of the heater 40 and the heat capacity of the sensing target portion 36 are substantially equal such that the roll-shaped medium can be set to the predetermined temperature.

In addition, the downstream side supporting member 35 is provided with the non-sensing target portion 38 which is not sensed by the infrared sensor 72, and the gap G is provided between the sensing target portion 36 and the non-sensing target portion 38. The gap G substantially separates the sensing target portion 36 from the non-sensing target portion 38 even if the sensing target portion 36 is still connected to the non-sensing target portion 38. Alternatively, the sensing target portion 36 may be entirely separated from the non-sensing target portion 38 and may be separately supported.

In addition, the downstream side supporting member 35 may be a thin plate. The printer 1 includes the supporting portion 52 which supports the thin plate in a state in which a gap is provided between the thin plate and the supporting portion 52.

The foregoing examples illustrate aspects of embodiments of the invention and illustrate that the radiation energy control is executed in the same manner both when the roll-shaped medium 2 is present at the sensing destination and when the roll-shaped medium 2 is not present at the sensing destination. The foregoing examples illustrate that the radiation energy control is executed using a simple method, while realizing various configurations including a configuration in which the downstream side supporting member 35 is firmly supported. The heater can be appropriately controlled.

Other Embodiments

The embodiments described above are intended to facilitate understanding of the invention and should not be interpreted as limiting the invention. It is needless to say that the invention may be modified and improved within a range not exceeding the spirit of the invention and furthermore, that the invention also includes equivalents thereto. In particular, even the embodiments described hereinafter are included in the invention.

In one embodiment, the liquid discharging apparatus (the liquid ejecting apparatus) is embodied by an ink jet printer. However, a liquid ejecting apparatus that ejects, discharges or the like a liquid other than ink may also be adopted, and it is possible to use such an apparatus in various types of liquid ejecting apparatus provided with a liquid ejecting head or the like which discharges minute droplets. Furthermore, the term "droplets" refers to the state of the liquid discharged from the liquid ejecting apparatus, and includes liquids of a droplet shape, a tear shape and a liquid which forms a line-shaped tail. In addition, the term "liquid" referred to herein may be a material which can be ejected from the liquid ejecting apparatus. For example, the liquid may be a material which is in a liquid phase state, and includes liquid bodies of high or low viscosity, and fluid bodies such as sol, aqueous gel, other inorganic solvents, organic solvents, solutions, liquid resin, and liquid metal (molten metal). In addition, the liquid not only includes liquids as a state of a material, but also includes solutions, disperses and mixtures in which particles of functional material formed from solids such as pigments and metal particulate are dissolved, dispersed or mixed into a solvent. In addition, representative examples of the liquid include the ink described in the embodiment or liquid crystal. Here, the term "ink" includes general aqueous inks and solvent inks, in addition to various liquid compositions such as gel ink and hot melt ink. A specific example of the liquid ejecting apparatus is a liquid ejecting apparatus which ejects a liquid which contains a material such as an electrode material or a color material in the form of a dispersion or a solution. The electron material, the color material or the like may be used in the manufacture and the like of liquid crystal displays, EL (electro-luminescence) displays, surface emission displays and color filters. In addition, the liquid ejecting apparatus may also be a liquid ejecting apparatus which ejects biological organic matter used in the manufacture of biochips, a liquid ejecting apparatus which is used as a precision pipette to eject a liquid to be a sample, a textile printing apparatus, a micro dispenser or the like. Furthermore, a liquid ejecting apparatus which ejects lubricant at pinpoint precision into precision machines such as clocks and cameras, a liquid ejecting apparatus which ejects a transparent resin liquid such as ultraviolet curing resin onto a substrate in order to form minute semispherical lenses (optical lenses) and the like used in optical communication devices and the like, or a liquid ejecting apparatus which ejects etching liquid such as an acid or an alkaline for etching a substrate or the like, may also be adopted as the liquid ejecting apparatus. Furthermore, it is possible to apply the invention to any one type of the liquid ejecting apparatuses described above.

In addition, the ink of the embodiment may contain resin emulsion. When the recording medium is heated, preferably, the resin emulsion exhibits the effect of sufficiently fixing a colorant ink onto the recording medium and of obtaining favorable image fastness properties by forming a resin film with wax (emulsion). According to the effects described above, the recorded object which is recorded using a colorant ink containing resin emulsion, has particularly excellent image fastness properties on a recording medium which is non-absorbent or has low absorbency in relation to ink. Examples of the resin emulsion are not limited hereto, but include monomers or polymers of (meth)acrylate, (meth) acrylate ester, acrylonitrile, cyanoacrylate, acrylamide, olefin, styrene, vinyl acetate, vinyl chloride, vinyl alcohol, vinyl ether, vinylpyrrolidone, vinyl pyridine, vinylcarbazole, vinyl imidazole and vinylidene chloride, in addition to fluororesin and natural resin. Of these, at least one of (meth)acrylic-based resin and styrene-(meth)acrylate copolymer-based resin is used in one embodiment, at least one of acrylic-based resin and styrene-acrylate copolymer-based resin may be used in an embodiment, and styrene-acrylate copolymer-based resin may also be used in an embodiment. Furthermore, the copolymers described above may be embodied by any of a random copolymer, a block copolymer, an alternating copolymer and a graft copolymer.

In addition, in one embodiment, the transporting unit 20 includes the first transport roller 23 which is positioned closer to the upstream side in the transport direction than the head 30, and the second transport roller 24 which is positioned closer to the downstream side in the transport direction than the head 30. However, the number and disposition of transport rollers are not limited thereto.

In addition, in one embodiment, an example was given in which the roll-shaped medium 2 is used as an example of the medium. However, the medium may also be a cut-sheet medium. When the medium is a cut-sheet medium, the likelihood is high that the medium is in a state of not being positioned on the downstream side supporting member 35 when the printing is started. However, it is desirable that the radiation energy of the heater 40 already be at an (appropriate) radiation energy for setting the medium to a predetermined temperature, even when the printing is started. If embodiments of the invention are used, it is possible to perform control of the heater 40 appropriately even when the medium is a cut-sheet medium.

In addition, in the embodiment, an example is given in which the infrared sensor 72 is used as the detecting unit. However, other sensors may also be used for the detecting unit. When the detecting unit is a sensor that detects electromagnetic waves which are radiated from the surface of the medium, the detecting unit may be a sensor that detects ultraviolet rays, microwaves and the like. Of the sensors, in order to estimate the temperature of a medium, it is more effective to use the infrared sensor. Furthermore, the term "infrared rays" refers to electromagnetic waves in a wavelength region of approximately 0.7 μm to 1000 μm. The infrared sensor 72 may detect electromagnetic waves in a wavelength region of at least a portion of the wavelength region of approximately 0.7 μm to 1000 μm.

In addition, the size of the sensing area which the detecting unit senses is variable. The size of the sensing area can be changed during operation of the printer 1. The size of the sensing area may change between a first state in which the roll-shaped medium 2 is present at the sensing destination, and a second state in which the roll-shaped medium 2 is not present at the sensing destination. In other words, the size of the sensing area may change between a case in which the detecting unit senses the sensing target portion (which is part of the downstream medium support 35) and a case in which the detecting unit senses the medium supported by the medium supporting portion.

In other words, as the detecting unit, a sensor is provided that can change the size of the sensing area. As shown in FIG. 6, the controller 60 controls (e.g., reduces) the size of the sensing area such that the sensing area fits within the sensing target portion 36 in the second state when the sensing target portion 36 is sensed because the medium 2 is not present. Meanwhile, in the first state in which the surface of the roll-shaped medium 2 is sensed, it is not necessary to fit the sensing area within the sensing target portion 36. As a result, the size of the sensing area can be increased (e.g., the size of the sensing area may be set to a maximum size) in relation to the size of the sensing target portion 36 in the second state in order to increase the uniformity of the sensing results by causing the detecting unit to sense a wide range.

Furthermore, by adopting such a configuration, since it is possible to appropriately exhibit the capability of the sensor which is used as the detecting unit, and it is possible to realize the more appropriate heater control.

What is claimed is:

1. A liquid discharging apparatus comprising:
a head that discharges a liquid onto a medium;
a medium supporting portion that supports the medium;
a heater that heats the medium supported by the medium supporting portion;
a detecting unit that performs sensing and detects energy; and
a control unit that controls radiation energy of the heater on the basis of the energy detected by the detecting unit,
wherein the medium supporting portion is provided with a sensing target portion that is sensed by the detecting unit when the medium is not present, and
wherein an emissivity of the sensing target portion is between 0.7 and 1,
wherein the medium supporting portion is provided with a non-sensing target portion that is not sensed by the detecting unit, and
wherein a gap is provided between the sensing target portion and the non-sensing target portion.

2. The liquid discharging apparatus according to claim 1,
wherein the detecting unit senses the sensing target portion or the medium supported by the medium supporting portion.

3. The liquid discharging apparatus according to claim 2,
wherein a difference between the emissivity of the sensing target portion and the emissivity of the medium is 0.1 or less.

4. The liquid discharging apparatus according to claim 2,
wherein a size of a sensing area that the detecting unit senses is variable, and
wherein the size of the sensing area changes between when the detecting unit senses the sensing target portion and when the detecting unit senses the medium supported by the medium supporting portion.

5. The liquid discharging apparatus according to claim 1,
wherein the sensing target portion is formed from anodized aluminum.

6. The liquid discharging apparatus according to claim 1,
wherein a heat capacity of the medium that is in a heating range of the heater and the heat capacity of the sensing target portion are substantially equal.

7. The liquid discharging apparatus according to claim 6,
wherein the medium supporting portion is a thin plate, and
wherein the liquid discharging apparatus further comprises a supporting portion that supports the thin plate such that a gap is provided between the thin plate and the supporting portion.

8. A liquid discharging apparatus comprising:
a head that discharges a liquid onto a medium;
a heater that heats the medium;
a detecting unit that performs sensing and detects energy;
a sensing target portion that is sensed by the detecting unit and that has an emissivity between 0.7 and 1;
a medium supporting portion that supports the medium; and
a control unit that controls radiation energy of the heater on the basis of the energy detected by the detecting unit,
wherein the medium supporting portion includes a non-sensing target portion that is not sensed by the detecting unit, and
wherein a gap is provided between the sensing target portion and the non-sensing target portion.

9. The liquid discharging apparatus according to claim 8,
wherein the sensing target portion is disposed within a heating range of the heater.

10. The liquid discharging apparatus according to claim 8,
wherein the detecting unit senses the sensing target portion or the detecting unit senses the medium.

11. The liquid discharging apparatus according to claim 10,
wherein a size of a sensing area that the detecting unit senses is variable, and
wherein the size of the sensing area changes between when the detecting unit senses the sensing target portion and when the detecting unit senses the medium.

12. The liquid discharging apparatus according to claim 8,
wherein the detecting unit senses the medium supported by the medium supporting portion.

13. The liquid discharging apparatus according to claim 8,
wherein the medium supporting portion is provided with the sensing target portion.

14. The liquid discharging apparatus according to claim 8,
wherein a difference between the emissivity of the sensing target portion and the emissivity of the medium is 0.1 or less.

15. The liquid discharging apparatus according to claim 8,
wherein the sensing target portion is formed from anodized aluminum.

16. The liquid discharging apparatus according to claim 8,
wherein a heat capacity of the medium that is in a heating range of the heater and a heat capacity of the sensing target portion are substantially equal.

17. The liquid discharging apparatus according to claim 8,
wherein the medium supporting portion is provided with a thin plate that supports the medium and a supporting portion that supports the thin plate such that gap is provided between the thin plate and the supporting portion.

* * * * *